United States Patent [19]

Sessa

[11] 4,026,071

[45] May 31, 1977

[54] WINDOW REGULATORS, ESPECIALLY FOR VEHICLE WINDOWS

[76] Inventor: Terenzio Sessa, Via Albani 5, Varese, Italy

[22] Filed: Feb. 27, 1976

[21] Appl. No.: 661,969

[30] Foreign Application Priority Data

Mar. 13, 1975 Italy ..... 21244/75
May 28, 1975 Brazil ..... 03387

[52] U.S. Cl. ..... 49/352
[51] Int. Cl.[2] ..... E05F 11/48
[58] Field of Search ..... 49/352; 254/51

[56] References Cited

UNITED STATES PATENTS

| | | | |
|---|---|---|---|
| 1,640,931 | 8/1927 | Gettner | 49/352 |
| 1,770,087 | 7/1930 | Quick et al. | 49/352 X |
| 1,997,646 | 4/1935 | Miller | 49/352 X |
| 3,281,991 | 11/1966 | Colell | 49/352 |
| 3,444,649 | 5/1969 | Rivolier | 49/352 |

FOREIGN PATENTS OR APPLICATIONS

| | | | |
|---|---|---|---|
| 2,215,222 | 12/1972 | Germany | 49/352 |
| 157,110 | 6/1921 | United Kingdom | 49/352 |

*Primary Examiner*—Philip C. Kannan
*Attorney, Agent, or Firm*—Shlesinger, Fitzsimmons & Schlesinger

[57] ABSTRACT

A window regulator mechanism, that is a mechanism adapted to raise and lower the window glass of a motor vehicle, is disclosed in which the tension of the cable which physically effects the raising and lowering movements of the window glass can be adjusted by the agency of a sawtooth clutch connecting the cable winding drum and a gear segment mounted coaxially therewith. The adjustment is effected by means of a specially provided torque wrench.

6 Claims, 2 Drawing Figures

WINDOW REGULATORS, ESPECIALLY FOR VEHICLE WINDOWS

This invention relates to a window regulator mechanism of the cable type, which can be applied, particularly but not exclusively, to motor car windows.

More exactly, the present invention has for its object a few improvements in window regulator mechanisms, of the kind which is well known to those skilled in the art, in which the drum about which the cable is wrapped and the shaft driving it to rotation are coaxial.

As these window regulators are to be mounted, for example on a motor car window, it is necessary to perform the correct adjustment of the tension of the cable, so that the window glass can be moved in a regular manner and maintained in any position between the two end positions corresponding to fully open and fully closed.

An object of the present invention is to provide a window regulator mechanism of the kind referred to above which, in addition to being comparatively simple and cheap to construct, is reliable in operation and by means of which the tension of the cable can be adjusted both in an accurate and quick manner.

To achieve this object, according to the present invention, it has been thought to provide a window regulator mechanism of the kind referred to above, which is characterized in that the drum about which the cable is wrapped is operatively connected by a unidirection clutch to a gear segment, or to a wheel which is at least partially crenellated and can be driven to rotation about the same shaft of the drum, the two cable ends being affixed to said winding drum, and to said wheel, respectively.

According to a preferred embodiment of the invention, said unidirectional clutch is a front sawtooth clutch, the teeth being maintained in mutual engagement by a leaf spring which is affixed to one end of the shaft aforementioned and acts upon the outer surface of the crenellated wheel.

The foregoing and other features, objects and advantages of the invention will become still clearer from a scrutiny of the ensuing explanatory disclosure, given with reference to the accompanying drawings, wherein.

Figure 2:
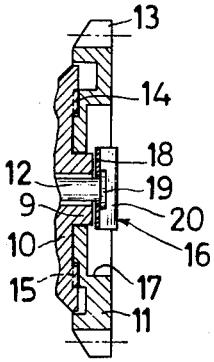
FIG. 2 is a close up view, in cross-section, of the device shown in FIG. 1.

Having now reference to the drawings, the window regulator mechanism in question comprises a drum 10 and a wheel 11 mounted for rotating as an entity about the same shaft 12. The wheel 11 is mounted on a hub 9 of the drum 10.

The drum 10 and the wheel 11, the latter being at least partially crenellated, as in 13, are operatively connected to one another for being rotated together by means of unidirectional clutch, which, in the example shown, comprises two annuli of saw-teeth, 14 and 15, formed on the confronting surfaces of the drum 10 and the wheel 11, respectively. A leaf spring 16 mounted on the shaft 12 provides to bias the wheel 11 (towards the left as viewed on the drawing) against the drum 10, so as to maintain the toothed annuli 14 and 15 in mutual engagement. It should be noted that the spring 16 is housed within a chamber 17 formed on the outer surface of the wheel 11, so as not to occupy any additional wide space beyond the size of the device.

As is clearly shown in the drawings, the spring 16 is structurally formed by a planar central portion 18, which reacts against a header 19 of the shaft 12, on opposite sides of which there are extended two arcuate portions 20 which react against the bottom wall of the chamber 17. It can also be noted that the planar portion 18 is also intended to confine the rightward stroke of the wheel 11 as the same is rotated relative to the drum 10, and also to limit the leftward stroke of the shaft 12.

A usual cable 21 for controlling the movement of the window glass (not shown) is wound around the grooved drum 10 and its opposite ends 22, 23 are affixed to the wheel 11 and the drum 10, respectively.

The end of the shaft 12 away of the wheel 11 has a conventional header 24 on which a crank (not shown) is to be keyed for controlling the rotation of the drum 10 and wheel 11 assembly during the normal operation of the window regulator. The functional connection between the shaft 12 and the drum 10 can be of any kind known to those skilled in the art, which thus is not shown, and in which there are provided end of stroke abutments so as to limit both the clockwise and anticlockwise rotations of the drum. A functional connection of this kind is shown, for example in the Italian Pat. No. 835 625.

The numerals 25 and 26 indicate the inner and the outer walls of a motor car door, respectively. By means of a flange 27, in a manner which is known per se, the above outlined window regulator is affixed to the inner wall 25 with the header 24 projecting outside that wall through a bore 28. Beneath the bore 28, through the wall 25, a second bore 29 is drilled, the task of which is to be explained hereinafter.

The adjustment of the tension of the cable in the window regulator according to this invention can be effected, with advantage, by a special torque wrench as generally indicated at 30.

The torque wrench 30 comprises a crank 31 which, through the conventional dynamometric mechanism, controls the rotation of an out shaft 32 at the end of which a pinion 33 is keyed. In the box 34 of the wrench 30 is formed, in addition, a bore 35 which is adapted to receive the header 24 and is arranged in such a way as to ensure the automatic meshing of the pinion 33 with the teeth 13 of the wheel 11.

Figure 1:
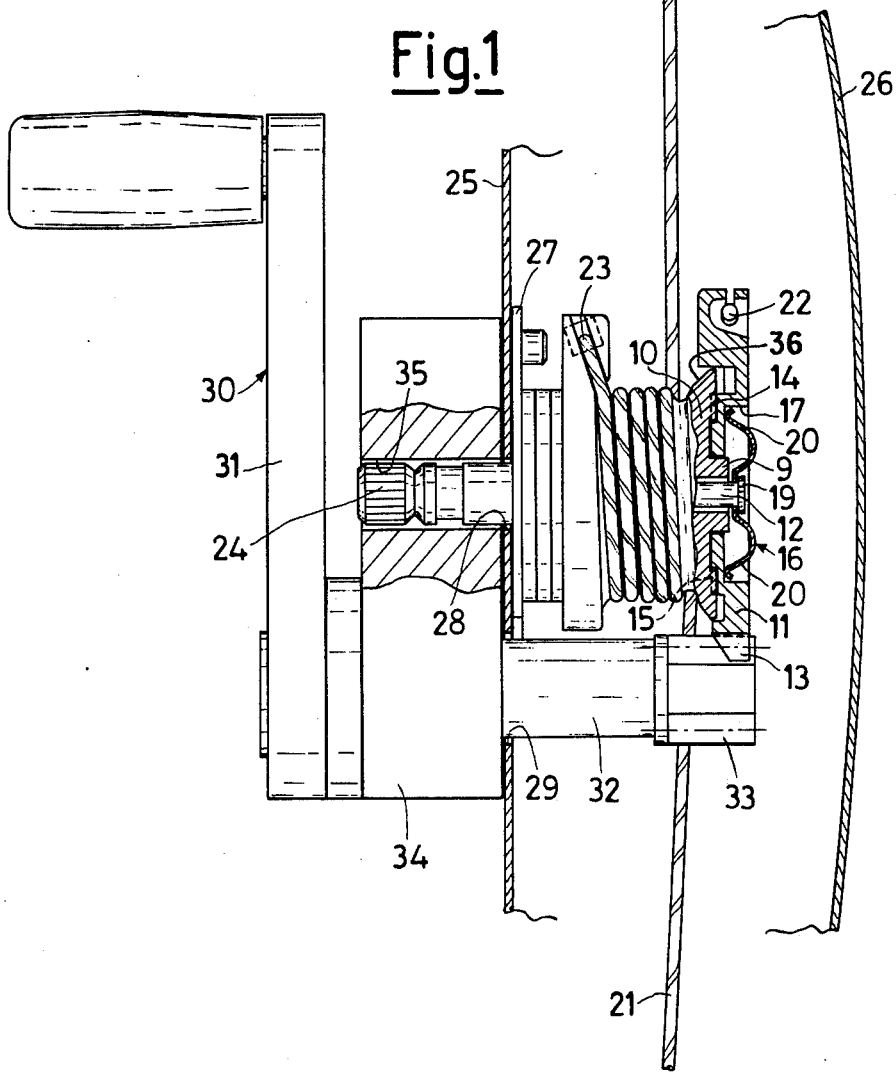
FIG. 1 is a vertical cross-sectional view showing the window regulator mechanism of the invention and the system by means of which the tension of the cable is adjusted after that the device has been installed, for example, on a motor car door.

The adjustment of the tension of the cable 21 is carried out as follows. The wrench 30 is applied to the door 25 in the position shown in FIG. 1, that is to say with the bore 35 inserted onto the header 24 and the shaft 32 inserted in the bore 29 so that the pinion 33 meshes with the teeth 13 of the wheel 11. Under these conditions, the wrench 30 is positively supported by the car door itself.

At this stage, the operator rotates the crank 31, for example anticlockwise, and thus causes, through the dynamometric mechanism, not shown, an anticlockwise rotation of the pinion 33. The rotation of the pinion 33 causes a clockwise rotation of the wheel 11 relative to the drum 10 (the latter is locked in either end of stroke position) and originates a pull of the cable 21. The tension of the cable 21 can be correctly adjusted by appropriately calibrating the dynamometric mechanism of the wrench so as to prevent the transfer to the wheel 11 of the force applied by the operator to the crank 31 when said force exceeds a preselected magnitude.

The operator withdraws the wrench from the door and the header 24 has applied thereto a conventional crank for manipulating the window regulator. It is apparent that, during the normal operation of the window regulator the drum 10 and the wheel 11 are rotated together by virtue of the sawtooth coupling which connects them and the bias of the spring 16.

It should be noted, in addition, that the drum 10 has its edge in correspondence with the wheel 11 raised such as at 36 to prevent the cable 21 from being caught between the teeth of the gears 14 and 15.

Another feature of the present invention is that, in the case of an erroneous initial calibration of the cable tension, or in the case of replacement of one or more pulleys, the wheel 11 can be brought to its starting position again after having set apart the teeth 14 and 15 undoing their engagement in the unidirectional clutch, by imparting an axial thrust towards the right so as to overcome the bias of the spring 16.

What I claim is:

1. In a window regulator device, especially for windows of vehicle doors, of the kind having a window-operating cable attached at one end to a winding drum mounted inside a vehicle door on a shaft which drives the drum selectively in opposite directions, and attached at its opposite end to a wheel which is rotatably mounted on said shaft adjacent said drum and is operatively connected by a unidirectional clutch to said drum, the improvement comprising crenellated means on said wheel registering with an opening in one side of said door and engageable by a tool, which is insertable through said opening from outside the door, and which is operable to rotate the wheel relative to the drum.

2. A device according to claim 1, wherein said means comprises a plurality of teeth formed on the peripheral surface of said wheel.

3. A device according to claim 2, including a torque wrench having an output shaft insertable through said opening in said door and equipped with a pinion capable of meshing with said teeth.

4. A device according to claim 1 wherein said unidirectional clutch comprises confronting saw-tooth surfaces formed on said drum and said wheel, respectively, and a leaf spring mounted in a recess in one side of said wheel and engaged with an enlarged-diameter head on one end of said shaft to bias the wheel axially on the shaft toward said drum.

5. A device according to claim 4, wherein the leaf spring comprises a planar central portion seated against said head, and two arcuate portions projecting from opposite sides of said central portion and against said wheel.

6. A device according to claim 1, wherein the edge of the drum has thereon a raised, circumferential flange portion confronting said wheel and projecting radially beyond said clutch teeth to prevent snarling of the cable in said clutch teeth.

* * * * *